US006709239B2

(12) United States Patent
Chandraker

(10) Patent No.: US 6,709,239 B2
(45) Date of Patent: Mar. 23, 2004

(54) THREE DIMENSIONAL BLADE

(75) Inventor: Amrit Lal Chandraker, Hyderabad (IN)

(73) Assignee: Bharat Heavy Electricals Ltd., New Delhi (IN)

( * ) Notice: Subject to any disclaimer, the term of this patent is extended or adjusted under 35 U.S.C. 154(b) by 0 days.

(21) Appl. No.: 10/176,077

(22) Filed: Jun. 21, 2002

(65) Prior Publication Data

US 2003/0086788 A1 May 8, 2003

(51) Int. Cl.[7] ..... F01D 5/14
(52) U.S. Cl. ..... 416/238; 416/243; 416/DIG. 2
(58) Field of Search ..... 416/243, 238, 416/223 A, DIG. 2, DIG. 5; 415/191

(56) References Cited

U.S. PATENT DOCUMENTS 4,585,395 A * 4/1986 Nourse et al. ..... 416/223 A
6,071,077 A * 6/2000 Rowlands ..... 416/223 A
6,299,412 B1 * 10/2001 Wood et al. ..... 416/223 A
6,331,100 B1 * 12/2001 Liu et al. ..... 416/238

* cited by examiner

*Primary Examiner*—Ninh H. Nguyen
(74) *Attorney, Agent, or Firm*—Venable LLP; Catherine M. Voorhees

(57) ABSTRACT

The invention relates to an improved three dimensional blade for axial steam turbine comprising a leading edge with inlet flow angle and a trailing edge with an outflow angle a pressure face, suction face and a chord which is the line connecting the leading and trailing edge and the betabi the stagger angle formed to the intersection of said chord and U-axis wherein the blade is made of varying cross-sections of profiles and and leaned such that the center of gravity of mid sections are shifted opposite to the direction of blade rotation and the blade sections from hub to tip are twisted to a gradual manner.

7 Claims, 13 Drawing Sheets

Profile Geometry Definition

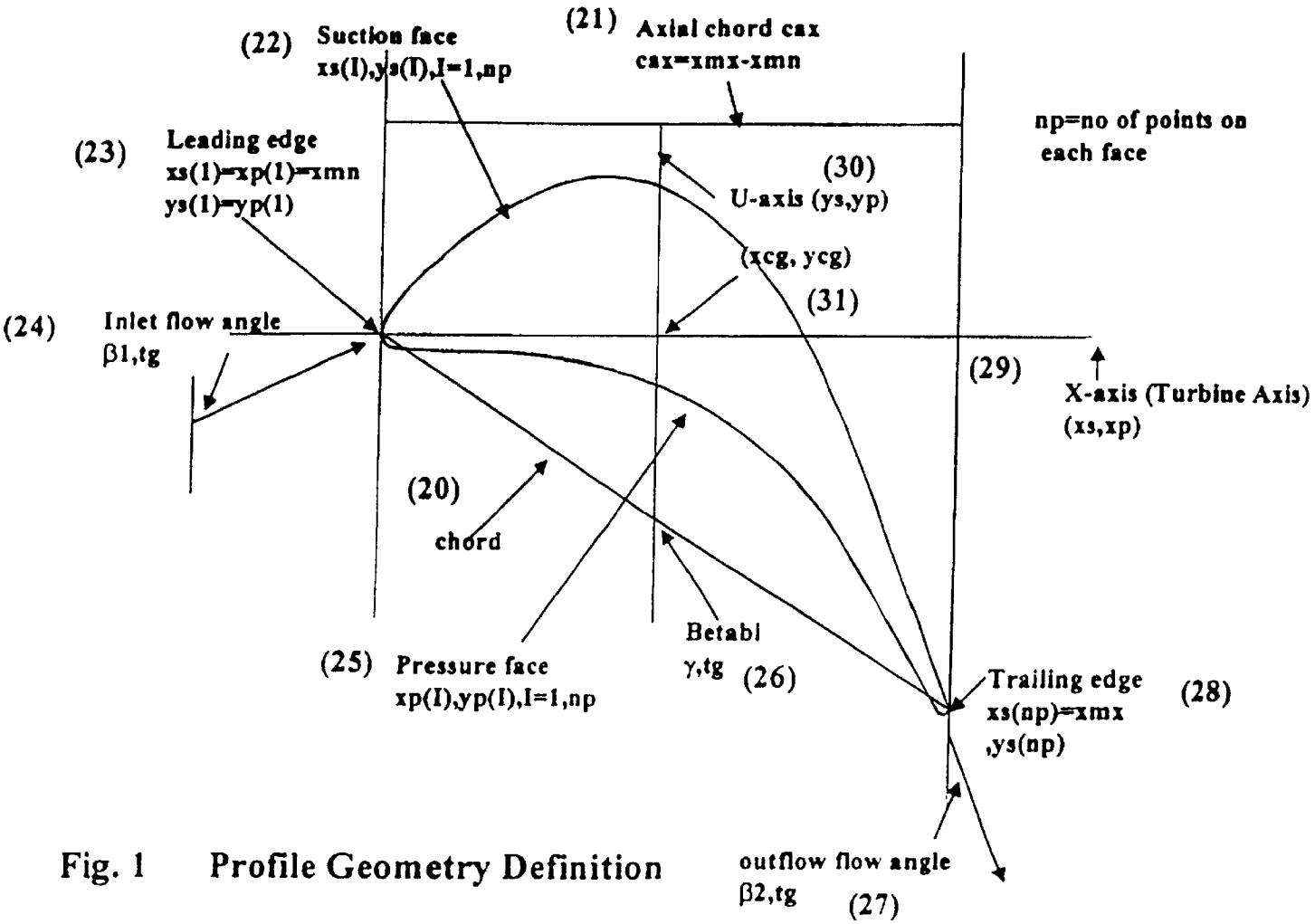
Fig. 1 Profile Geometry Definition

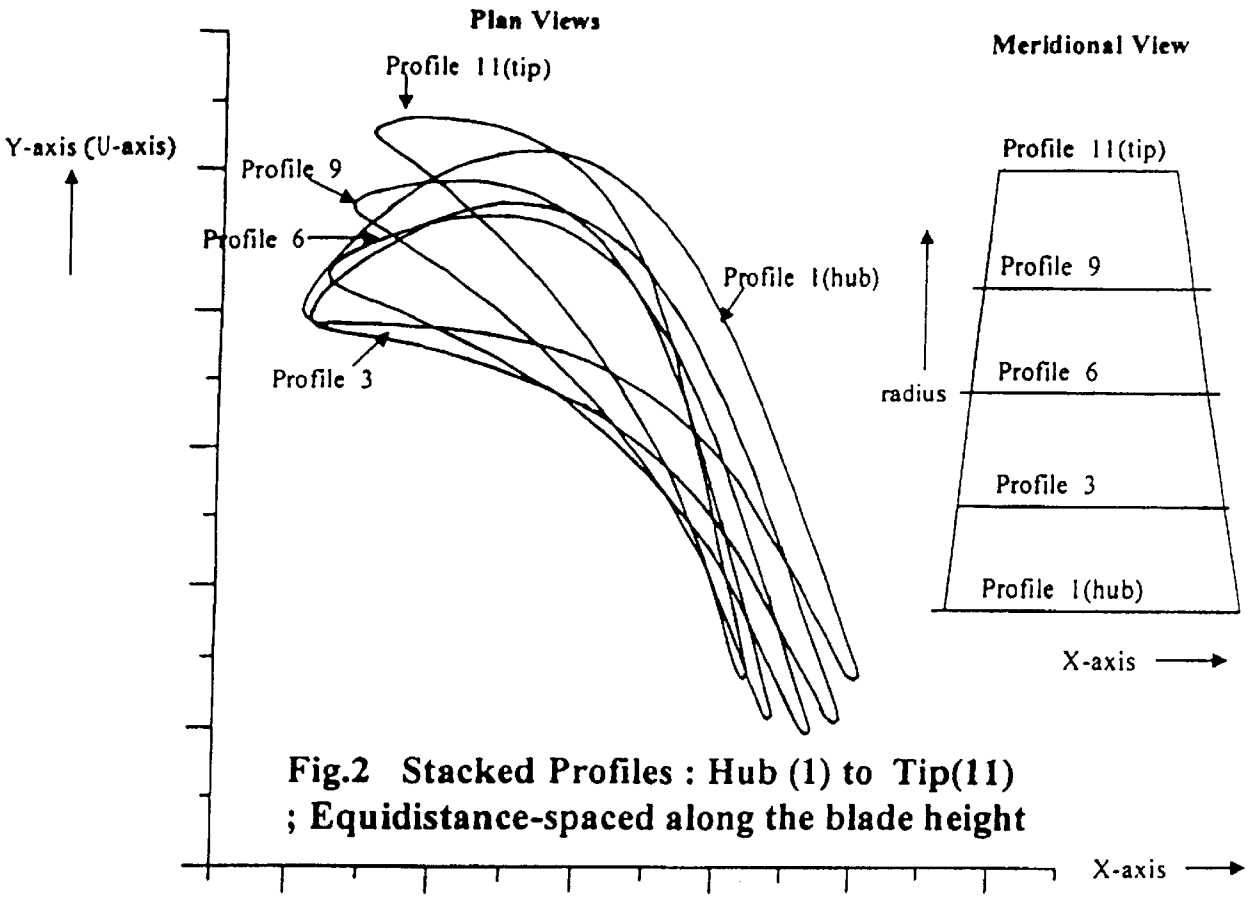
Fig.2 Stacked Profiles : Hub (1) to Tip(11)
; Equidistance-spaced along the blade height Fig.3 Profile Description & Bezier Knots
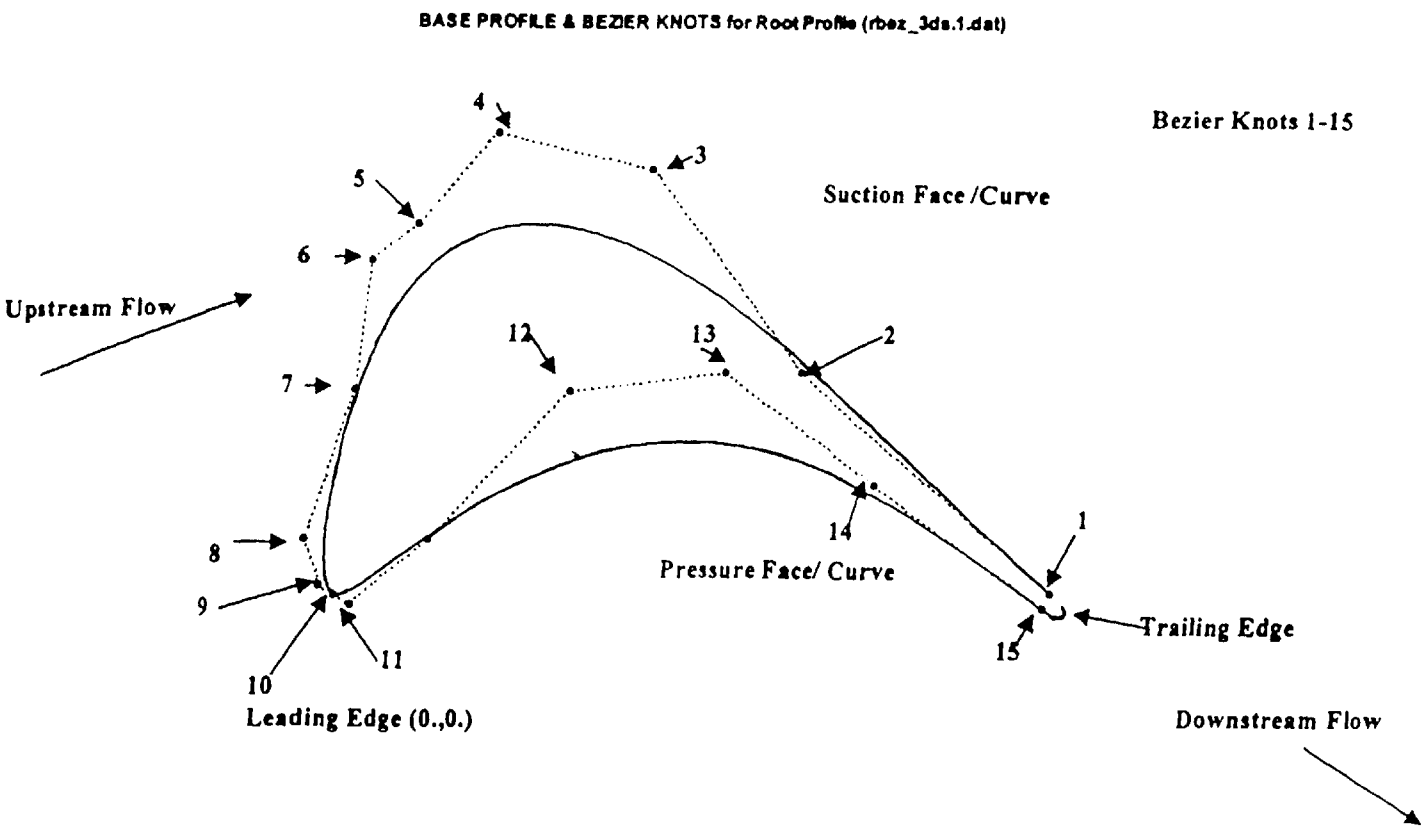

Basic Profiles of 3dsl_r Blade : Root & Mean

BASE PROFILE & BEZIER KNOTS FOR ROOT PROFILE (rbez_3ds.1.dat) (33)

BASE PROFILE & BEZIER KNOTS FOR MEAN PROFILE (rbez_3ds.6.dat) (34)

Basic Profiles of 3dsl_r (tip) and a typical Cylindrical Blade 'cyl'

BASE PROFILE & BEZIER KNOTS FOR TIP PROFILE (rbez 3ds11.dat) (35)

BASE PROFILE & BEZIER KNOTS : A TYPICAL CYLINDRICA BLADE (36)

Surface Pressure Distribution for Profiles

Iso-Pressure Contour Plots

Iso-Pressure Contour Plots

Stacking & Leaning of Profiles for 3dsl_r Blade Formation

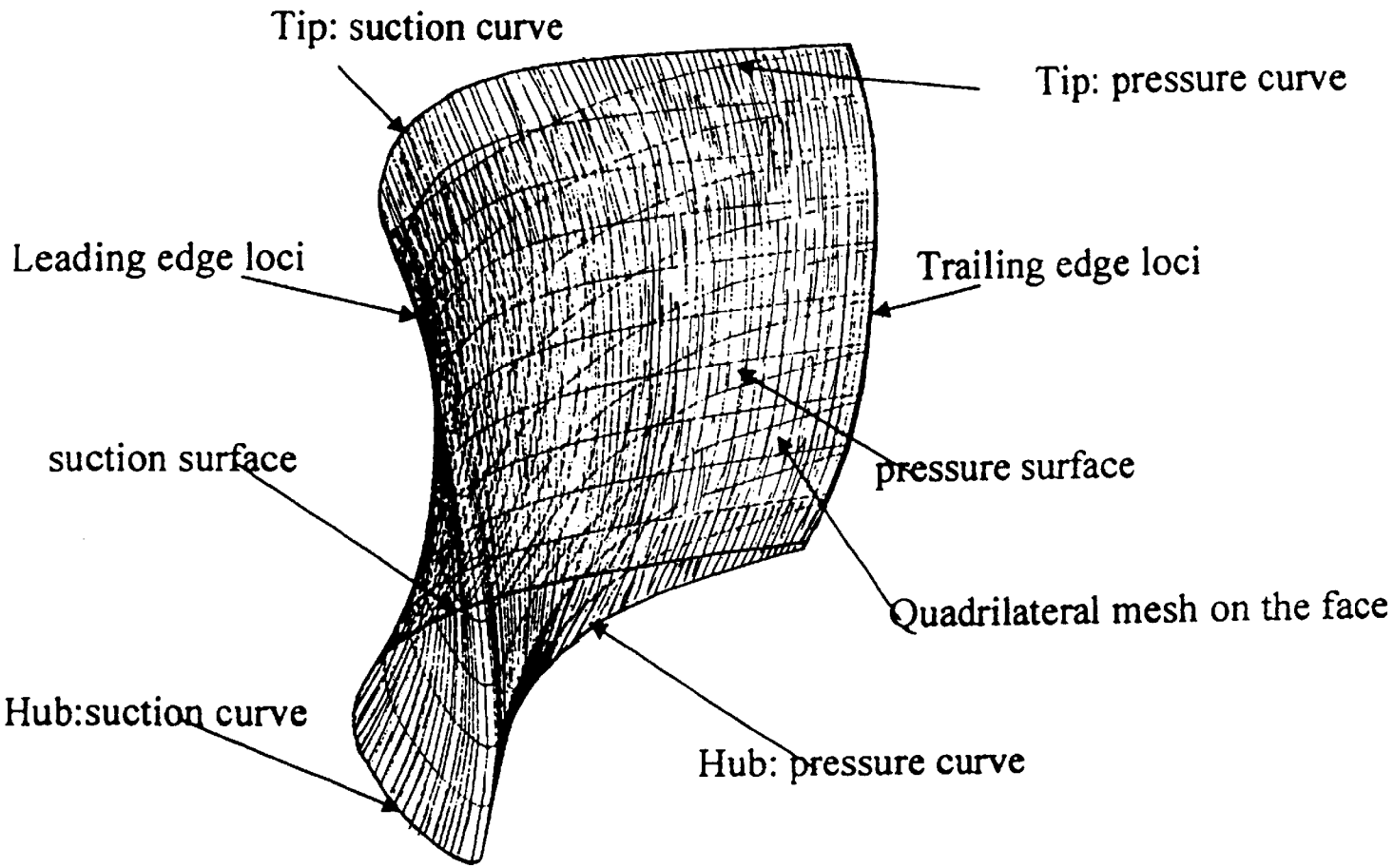
Fig. 10 3dsl_r Blade

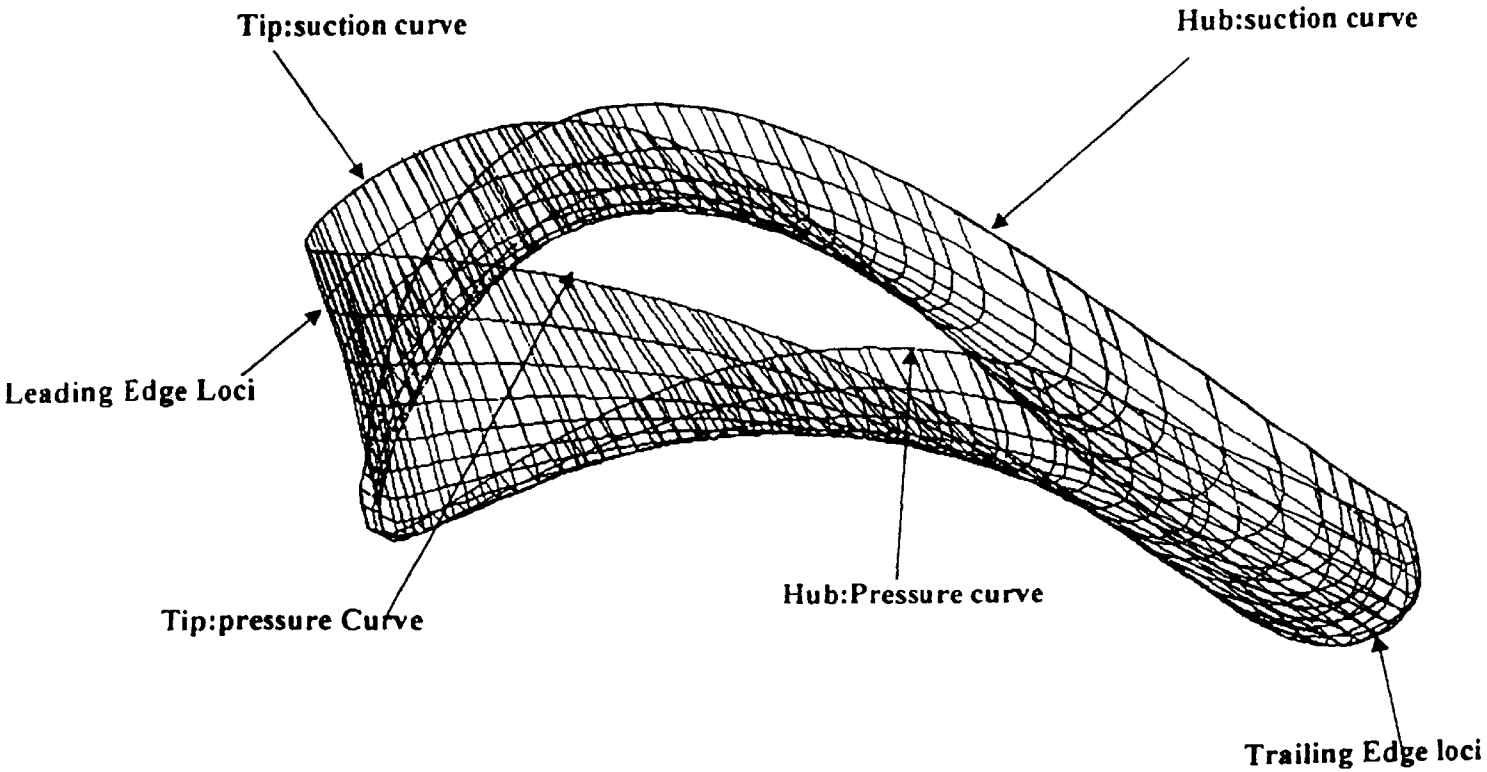
Fig. 11 3dsl_r Blade : Isometric View

Fig. 12 : Surface Pressure Distribution : 3dsl_r Blade
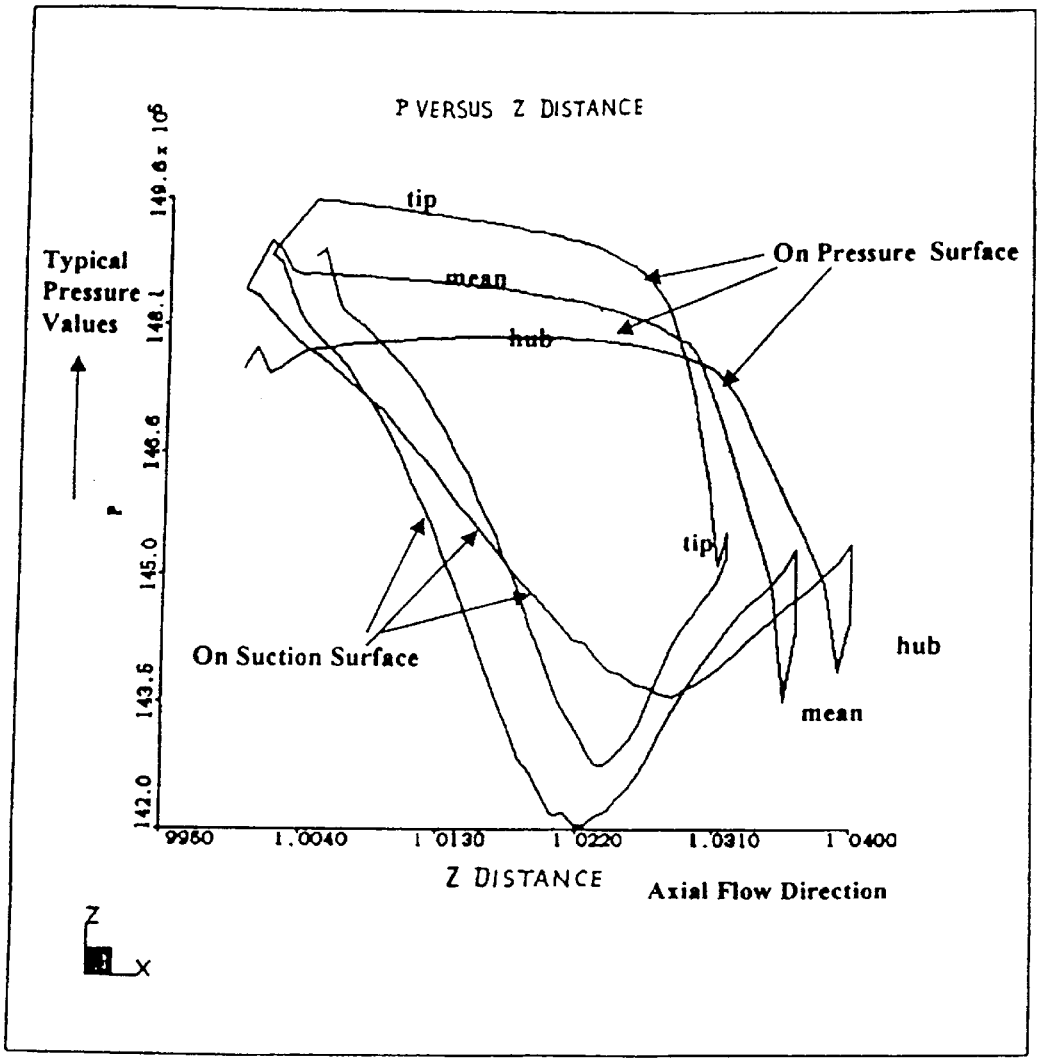

Fig. 13 : Surface Pressure Distribution : Cyl Blade
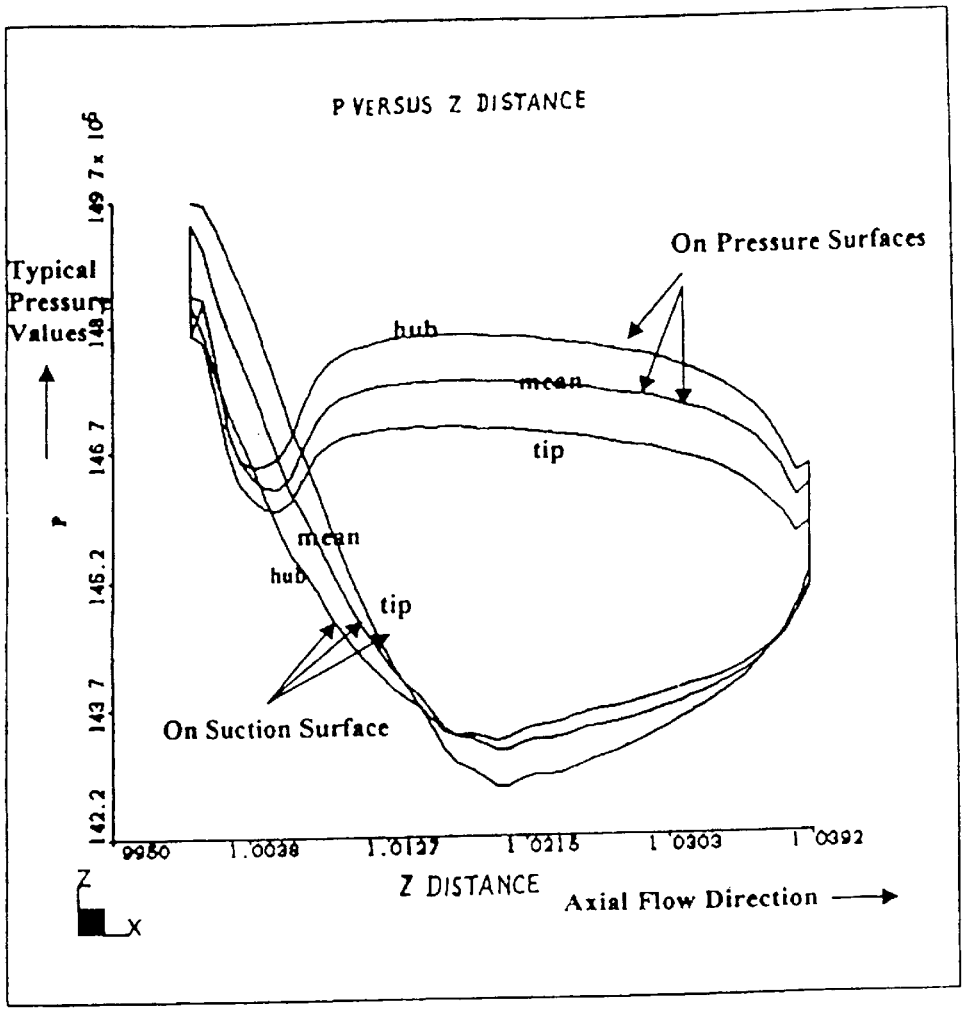

THREE DIMENSIONAL BLADE

The invention relates to an improved three dimensional blade for axial steam turbine particularly to the aerodynamic improvement of moving blades pertaining to entry stages of axial steam turbine.

SUMMARY OF THE INVENTION

A conventional blade known as cylindrical blade, is cylindrical in shape and made of a constant cross-section throughout the blade height.

The invention primarily relates to moving blade of axial steam turbines, but the principle and design procedure are applicable for also to fixed blades, known as guide or stationary blades. The term 'turbine blade' is used in the description to denote aerofoil blades. The efficiency of turbine is of paramount importance for cheaper power generation. The blades are supposed to be most crucial apart from stationary flow path components for efficiency of the turbine.

The conventional blades is of constant cross section and cylindrical in shape over the blade height. The U.S. Pat. No. 5,779,443 which was granted in 1998 is one such belonging to prior art in this area. At any cross section the shape of the profile remains same.

There are disadvantages associated with steam turbine runner blades in high and intermediate pressure cylinders are of low height and low aspect, and many a time employ cylindrical blades and in such a blade row the losses due to secondary flow are significant. The secondary flow is opposed to main flow in direction and caused due to turning of boundary layer along the hub and casing.

Therefore, the main object of the present invention is to propose an improved blade to reduce the losses by leaning and twisting the blade profiles so as to have aft-loaded blade instead of centrally loaded one at sections near root and tip. According to the present invention there is provided an improved three dimensional blade for axial steam turbine comprising a leading edge for inlet flow and a trailing edge for an angle, a pressure face, suction face and a chord which is the line connecting the leading and trailing edge and the betabi, the stagger angle formed at the intersection of said chord and U-axis wherein the blade is made of varying cross-sections of profiles hub to tip and leaned such that the centre of gravity of mid sections are shifted opposite to the direction of blade rotation and the blade sections from hub to tip are twisted in a gradual manner.

The nature of the invention, its objective and further advantages residing in the same will be apparent from the following description made with reference to the non-limiting exemplary embodiments of the invention represented in the accompanying drawings:

FIG. 1 shows the profile geometry definition of the blade of this invention.

FIG. 2 shows the stacked profiles hub to tip of the blade of the invention.

FIG. 3 shows the blade of the invention with profile description Bezier Knots.

Figures 9A, 9B:
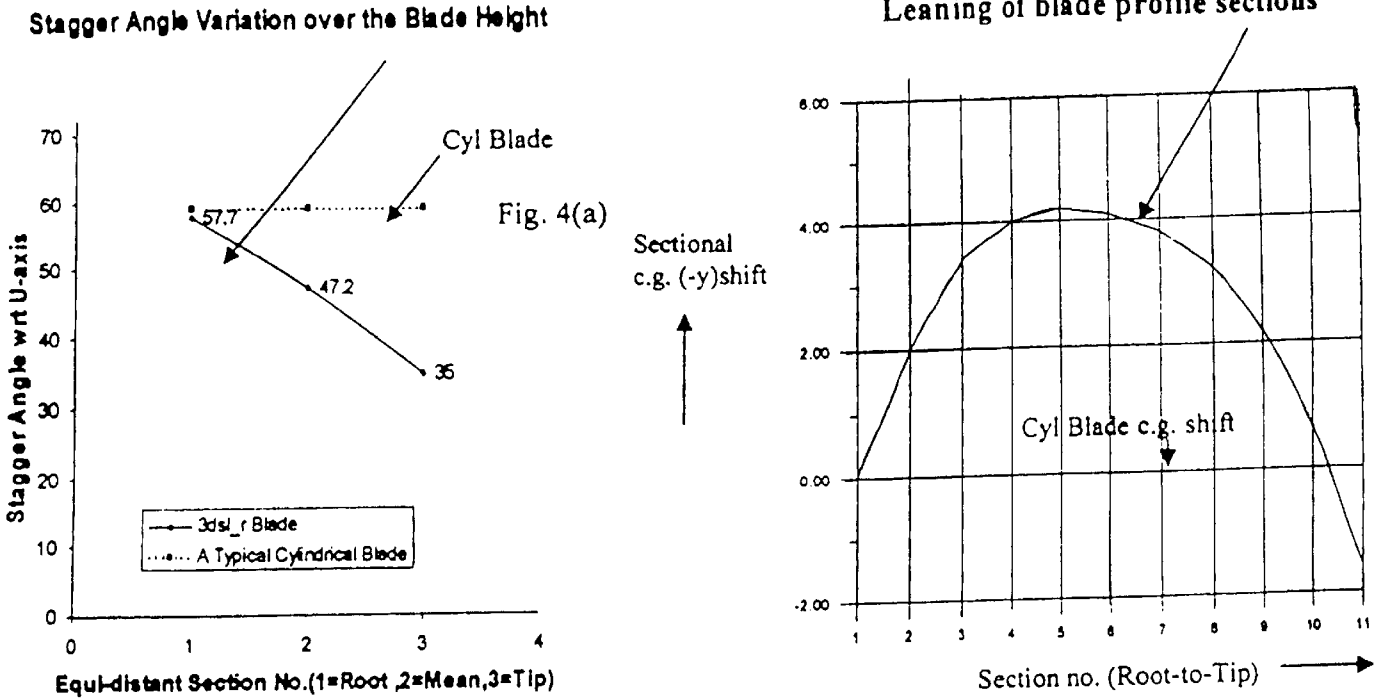
FIG. 9A shows for 3ds1_r blade the stagger angle variation over the blade height.

FIG. 9B same as FIG. 9A showing leaning of blade profile section.

FIG. 10 shows various curves and CAD view of 3ds1_r blade.

FIG. 11 shows Iso-metric view of various curves of a 3ds1_r blade.

FIG. 12 shows surface pressure distribution of a 3ds1_r blade.

FIG. 13 shows the surface pressure distribution of cylindrical blade.

DETAIL DESCRIPTION

The present invention relates to the aerodynamic improvement of moving blades pertaining to entry stages of axial steam turbines.

The invented blade is made of varying cross-sections and leaned such that the centres of gravity of these sections lie in a curve instead of a straight line. Centres of gravity of mid sections are shifted to the direction opposite of blade rotation compared to those of end sections. In addition to it the blade section from hub to tip are twisted in gradual manner unlike single setting angle in case of cylindrical blades. The purpose of the setting and leaning was reduction of pressure loading at end walls. This has resulted in significant improvement in aerodynamic efficiency.

The profile or section is made of two surfaces: (FIG. 1) suction face (22) and pressure face (25), each joining leading edge (23) to trailing edge (28), X-axis (29) and U-axis (30) concide to turbine axis and circumferential direction respectively. Usually the centre of gravity lies at origin of co-ordinate axies (31). The blade or profile is set at angle 'betabi' (26) or $\gamma$, tg, is also known as stagger angle (26) with respet to U-axis (30). Chord (20) is defined as profile length joining leading edge (le) (23) to traiing edge (te) (28). Axial chord (21) is the projected length of the profile on X-axis (29). Inlet (24) and exit flow (27) angles $\beta 1$, tg and $\beta 2$, tg are fluid flow angles (24, 27) with respect to tangent (U-axis) (30) respectively. The profile faces can be specified by various ways; e.g.; through discrete points (x,y co-ordinates), through a set of arcs and through bezier points (1–15) FIG. 3.

Figure 4A:
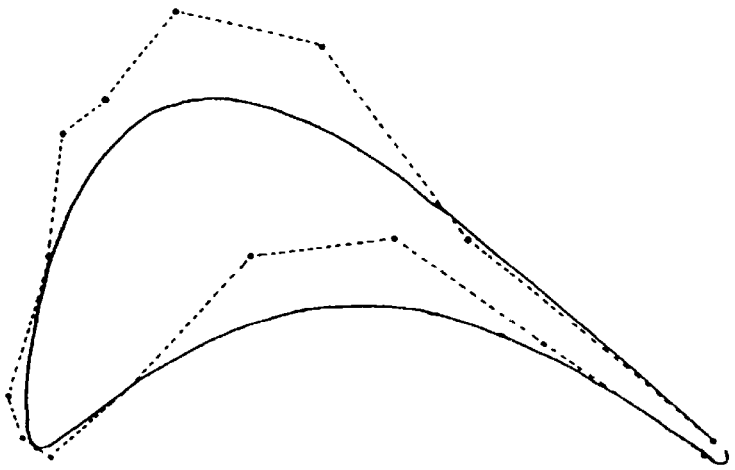
FIG. 4A shows the base profile and Bezier knots for root profiles of the blade of the invention.
Figure 4B:
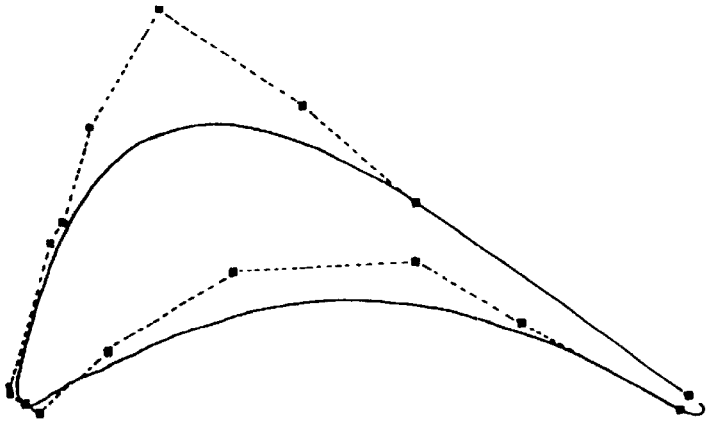
FIG. 4B shows the base profile Bezier knots for mean profile.
Figure 5A:
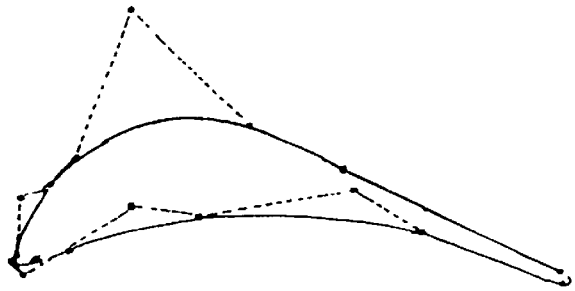
FIG. 5A shows the base profile and Bezier Knots for tip profile of the blade of the invention.
Figure 5B:
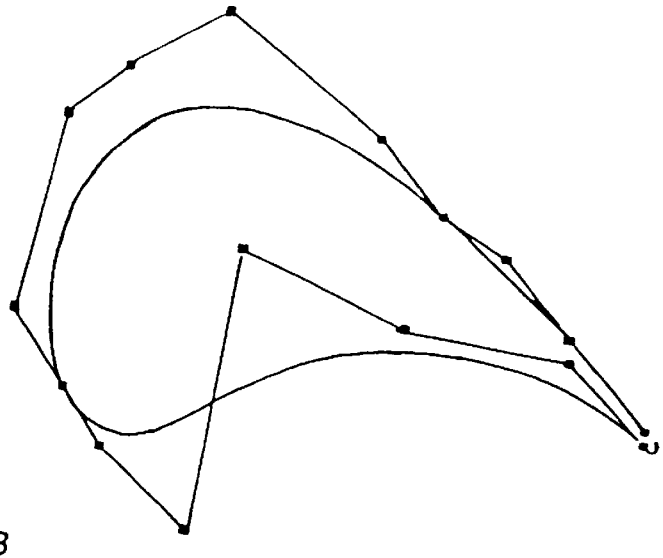
FIG. 5B shows the base profile & Bezier Knots for a typical cylindrical blade.
Figure 6A:
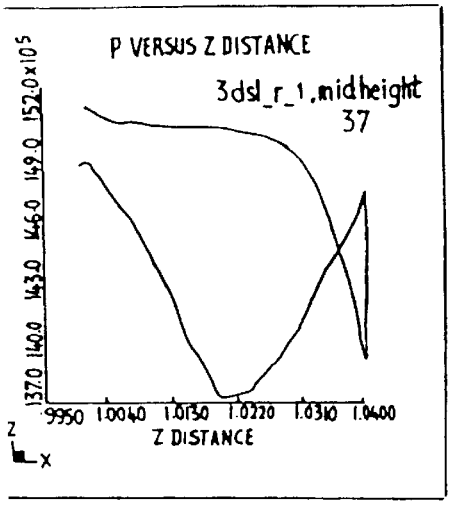
FIG. 6A shows the surface pressure distributions for profiles of 3ds1_r1 midheight blades.
Figure 6B:
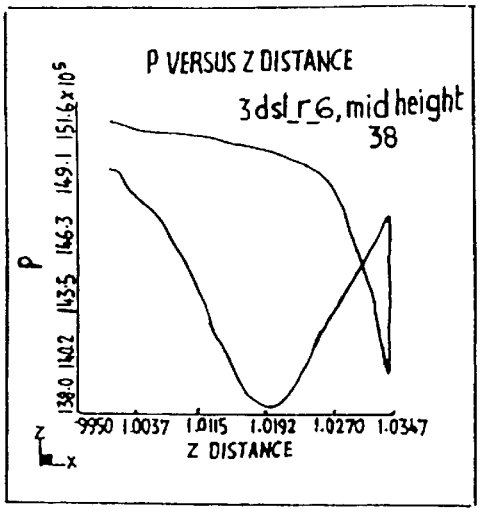
FIG. 6B shows the surface pressure distribution for profiles of 3ds1_r6, mid height blades.
Figure 6C:
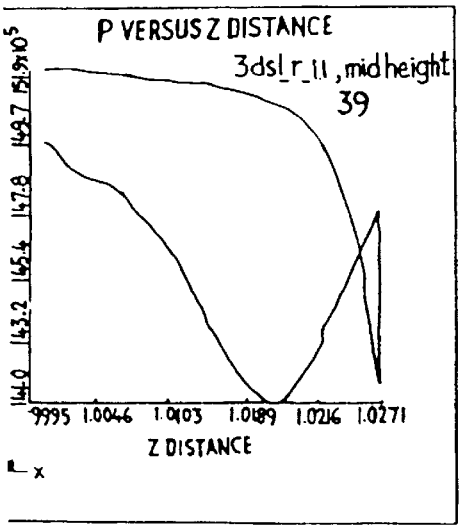
FIG. 6C shows the surface pressure distribution for profiles of 3ds1_r11 mid height blades.
Figure 6D:
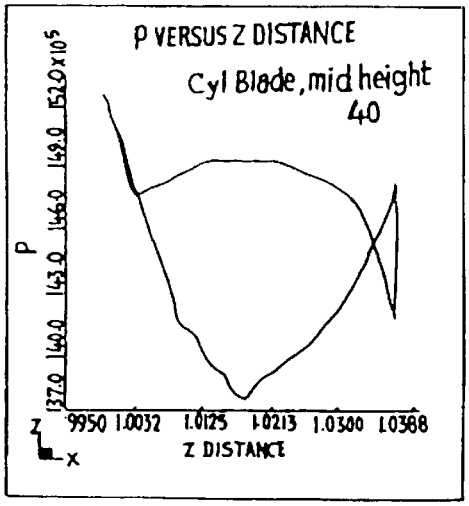
FIG. 6D shows the surface pressure distribution of cy1 blade mid height.

In this invention the proposed blade is made of many such profiles (FIG. 1) but with varying shape and other parameters such as stagger angle (26) chord (20) axial chord (21), cross sectional areas. The centres of gravity (xcg, ycg) of the profiles do not coincide in x–y planes. The areas of cross section, stagger angles, solidity (pitch/chord) and axial chords monotonously decrease from hub to tip, whereas pitch ($=2\pi$ r/no of blades; r=radius where the profile is located) increases heightwise. A typical sketch of such set of stacked profiles for alternate 5 sections of total 11 sections are shown in FIG. 2. The meridional view (x–r plane) in right side shows the blade in height with profile section locations for which the plan views (x–u plane; u=circumferential direction) are shown leftside. With such configuration of the blade the invention provides improvements in aerodynamic efficiency. Geometry Design: FIG. 3 shows the base profile (stagger=90.0) and schematic location of bezier knots used to describe both the surfaces. In this investigation 3 fundamental base profiles belonging to root, mean and tip sections are proposed in terms of bezier knots (FIGS. 4 and 5). As an illustration FIG. 5 also provides a schematic view of cylindrical blade profile and associated bezier knots. These 3 profiles of 3ds1_r family are stacked with specified stagger and interpolated parabolically (Lagrangian type) to 11 equidistant sections such that 1, 6 and 11 sections coincide to original root, mean and tip profiles: 3ds1_r1 3ds1_r6; 3ds1_r11; respectively (FIG. 2).

2D-CFD Analysis: Each of the base profiles after staggered to values desired for 3d blade formation is analysed for aerodynamic performance by a CFD (Computational Fluid Dynamic) solver and compared with the performance of profile of a cylindrical blade 'Cy1,' which was also analysed by same CFD solver.

Figure 7B:
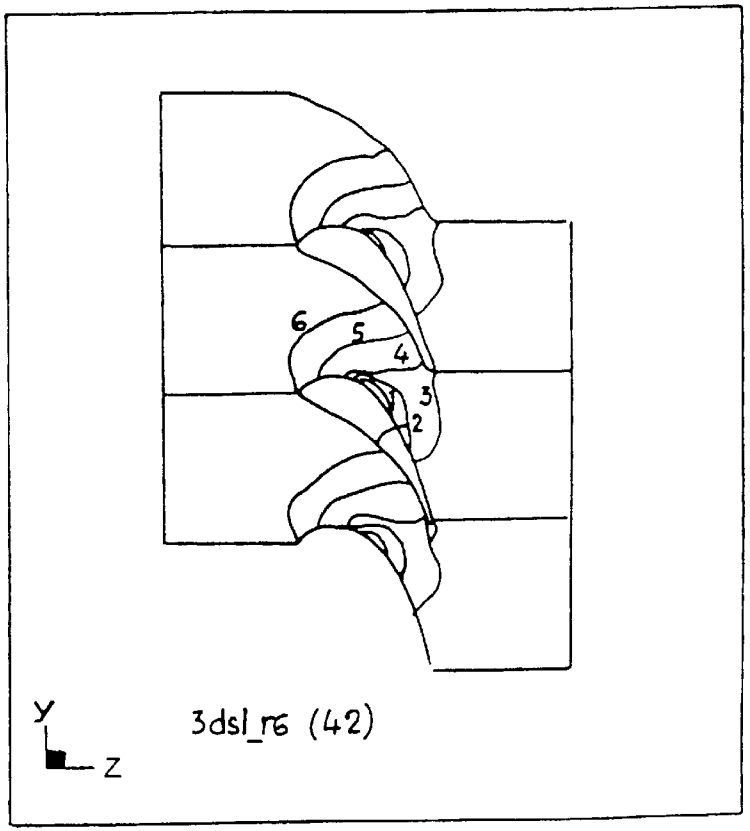
FIG. 7B shows Iso-Pressure Contour plots of a 3ds1_r6 blade.
Figure 7A:
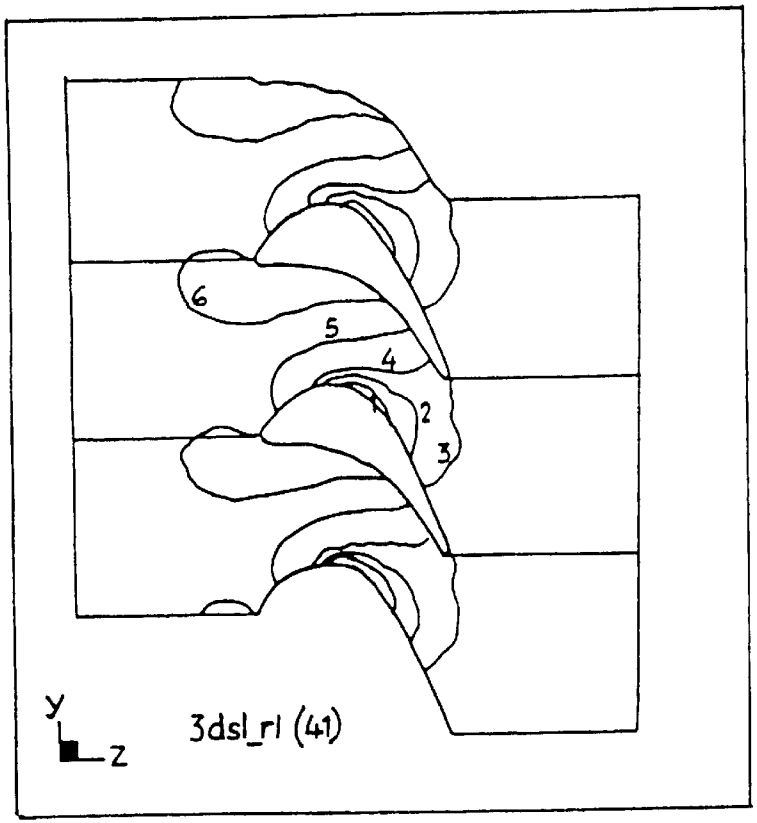
FIG. 7A shows Iso-Pressure Contour plots of a 3ds1_r1 blade.
Figure 8B:
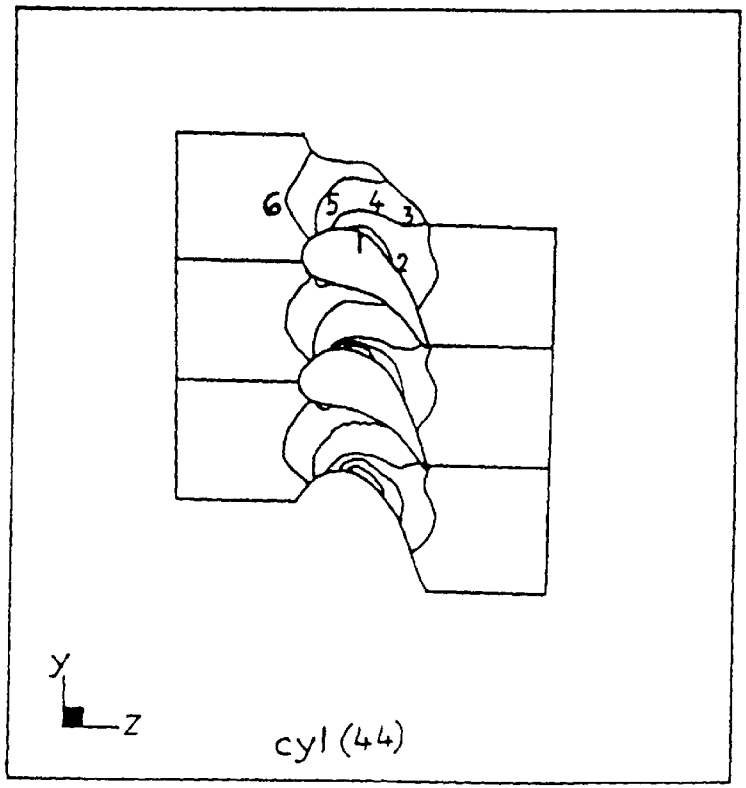
FIG. 8B shows Iso-Pressure Contour plots of a cy1 blade.
Figure 8A:
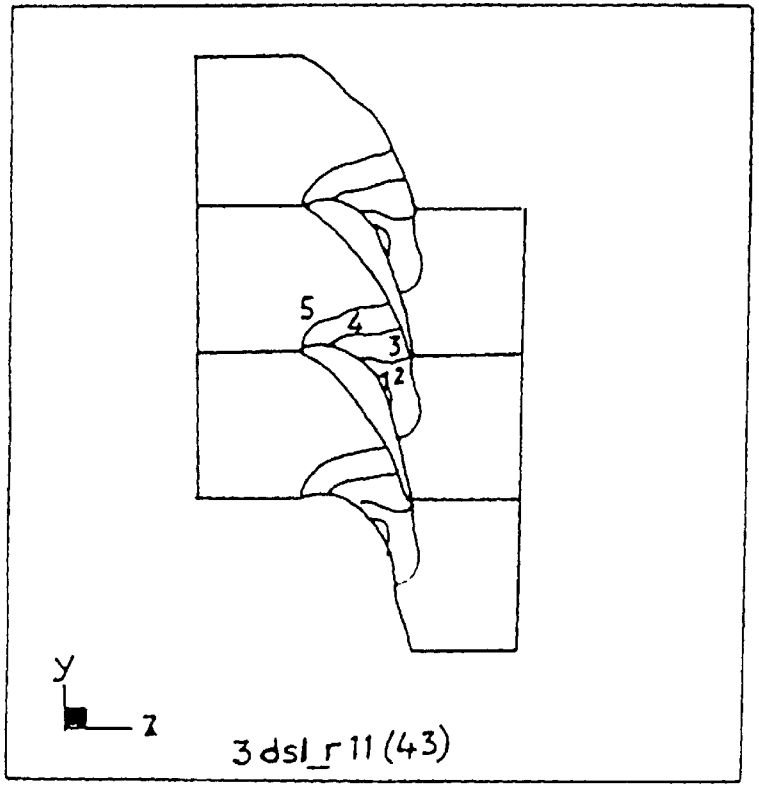
FIG. 8A shows Iso-Pressure Contour plots of a 3ds1_r11 blade.

Surface pressure distribution with respect to axial direction say z and pressure contour plots indicate that 3ds1_r blade profiles are aft-loaded compared to that of a corresponding cylindrical blade profiles which is centrally loaded with flat top on middle region of pressure face. The 3ds1_r blade profiles has lesser acceleration and wider pressure difference between faces at inlet part (FIGS. 6–8).

Cascade performance of individual profiles is simulated by a CFD solver using superheated steam properties (in S1 Units) and the ratio of specified k=1.3.

Energy loss coefficient defined as $$\zeta = 1 - \left[1 - (p2/po2) - \frac{K-1}{K}\right] \Big/ \left[1 - (p2/po1)\frac{K-1}{K}\right]$$

where p2 is mass-averaged static pressure at the outlet; po1 and po2 are mass averaged stagnation pressure at the inlet and exit of the cascade.

Each of the blade is made of single profile for desired aspect ratio h/c, h and c are the blade height and chord, respectively. The blades are set at some stagger angle γ, tg (26) with usually optimum pitch-cord ratio s/c (s is the pitch).

The stagger angle (26) is acute angle between profile chord (20) and circumferential direction (30). The incoming flow angle (24) denoted by β1, tg; i.e; flow angle measured with respect to circumferential direction, is specified such that the flow enters more or less normal to the leading edge (23) of the blade.

From the CFD simulation relevant results needed at the flow pattern within the cascade (e.g. pressure contours, streak plot, vector plot and surface loading), energy loss coefficient and nodal-averaged outlet flow angle (27) β2, tg at the mid heights. A typical result is tabulated here for h/c=2.2

| Case | γ, tg | β1, tg | s/c | ζ | β2, tg |
|---|---|---|---|---|---|
| 3ds1_r1 | 57.7 | 57.2 | .85 | .11 | 28.75 |
| 3ds1_r6 | 47.2 | 84.3 | .85 | .09 | 26.7 |
| 3ds1_r11 | 35 | 95.7 | .85 | .09 | 19.04 |
| Cy1 | 59 | 84.3 | .85 | .09 | 27.3 |

Individually, the cylinder profile 'Cy1" proves to be as good aerodynamically as other profile of the proposed 3ds1_r, Blades, both from lower loss coefficient and smooth surface pressure distribution point of views.

3D-Blade Design: 3ds1_r blade is formed by stacking 3 basic profile with Lagrangian parabolic distribution and leaning them as per Design Curve (FIG. 9). For an aspect ratio h/c (=blade height/chord at hub) 1.326, the cross sectional areas vary from mean section +36±2% (at hub) to −30±2% (at tip). The stagger angle variation is from +10.5±1 to −12.2±1 degrees with respect to mean section. Section leaning (profile shifting in negative U-direction) for such a blade is shown in FIG. 9. Such a 3ds1_r blade with hub and tip areas 374, and 194.7 $mm^2$, of height 63.4 mm will have a mass of 0.137 Kg and cause centrifugal stress at root (of root radius 425 mm, 3000 rpm machine and 7740 $Kg/m^3$ material density) 16.34 $N/mm^2$.

The 3ds1_r blade is designed by inhouse software 'quick3ds1' which needs as basic inputs 2 or more input bezier profiles (data set profiles in term of bezier knots) (usually 3 profiles); their stagger angles and radial locations (r coordinate) along the blade height and—y-shift of centre of gravity (see FIG. 9) for leaning. The isometric views of 3ds1_r blade are shown in FIGS. 10–11. Original blade of a given height (63.4 mm) can be reduced in height from tip side or extrapolated toward tip side. Thus blade height varies from 40 to 75 mm which root axial chord 40 mm. The aspect ratio variation found useful for loss reduction is 0.85 to 1.5.

3D-CFD Analysis: Three dimensional flow analysis by a CFD solver was carried out for a typical flow condition resembling high pressure power turbine first stage; for both cylindrical blade 'Cy1' and 3ds1_r blade. Surface pressure distribution with respect to axial direction, say z, and aerodynamic efficiency are computed. The 3ds1_r blade appears to be aft-loaded showing large pressure differences between pressure and suction surface at minimum pressure points. The typical distribution is inclined trapezoid in shape; viz, the shape of pressure variation in the first part of suction face is somewhat parallel to that of second part of pressure face. The pressure minima is toward the trailing edge side (FIG. 12). The cylindrical blade is centrally loaded with pressure minima midway (axial chord). The pressure distribution shape appears to that of a covered cup type (FIG. 13).

Efficiency is defined here by 2 ways, each one based on mass-averaged conditions at cascade station upstream (1) and downstream (2):

1) Total to total isentropic efficiency $$\eta_{tt} = \frac{Tt_1 - Tt_2}{Tt_1(1 - 1/pr)};\ pr = \frac{(p_1^t)}{p_2^t}\frac{k-1}{k}$$

Tt, pt represent total absolute temperature and total absolute pressure, k=cp/cv=1.3 for superheated steam.

2) Total-to-total efficiency

Polytropic:

$$\eta_{p_tt} = \left(\frac{K-1}{K}\right)\frac{\ln(pt_1/pt_2)}{\ln(Tt_1/Tt_2)}$$

Isentropic:

$$\eta_{_tt} = \left(1. - \frac{pt_2}{pt_1}\right)\frac{K-1}{K} \Big/ \left(1. - \frac{Tt_2}{Tt_1}\right)$$

For various blade heights and fixed chord 47.8 mm (axial chord=40 mm at root, the results are as follows (machine rpm=3000): both for 3ds1_r and Cy1 blades,

| Case | ηtt | η_tt | ηp_tt | Blade Height mm |
|---|---|---|---|---|
| Cy1 | .883 | .884 | .881 | 30 |
| Cy1 | .873 | .76 | .76 | 63.4 |
| 3ds1_r | .855 | .851 | .848 | 31.7 |
| 3ds1_r | .889 | .885 | .833 | 38.4 |
| 3ds1_r | .915 | .91 | .909 | 44.38 |
| 3ds1_r | .93 | .90 | .904 | 63.4 |
| 3ds1_r | .929 | .925 | .925 | 75 |

and compared with the performance of a cylindrical blade 'Cy1'.

The invention described herein is in relation to a non-limiting embodiment and as defined by the accompanying claims.

We claim:

1. An improved three dimensional blade for axial steam turbine comprising a leading edge with an inlet flow angle and a trailing edge with an outflow angle, a pressure face between the leading edge and the trailing edge, a suction face between the leading edge and the trailing edge on the opposite side of the pressure face and a chord, which is the line connecting the leading edge and the trailing edge through a stagger angle formed at the intersection of said chord and a U-axis coinciding with the circumferential direction of the blade, wherein the blade is made of varying cross-sections of profiles and leaned such that the centre of gravity in a mid-section of each varying cross-section is shifted opposite to the direction of blade rotation and the blade sections from hub to tip are twisted in a gradual manner, and wherein the said blade is formed by stacking three basic profiles with lagrangian parabolic distribution and leaning them as per a design curve.

2. The improved three dimensional blade for an axial steam turbine as claimed in claim 1, wherein the sectional leaning (profile shifting in (−U) direction) for the blade varies (hub-to-tip) from 0 mm (at hub) to 4.2 mm then decreases to −1.6 mm (at tip); for a blade root chord of 47.8 mm.

3. An improved three dimensional blade for axial steam turbine comprising a leading edge with an inlet flow angle and a trailing edge with an outflow angle, a pressure face between the leading edge and the trailing edge, a suction face between the leading edge and the trailing edge on the opposite side of the pressure face and a chord, which is the line connecting the leading edge and the trailing edge through a stagger angle formed at the intersection of said chord and a U-axis coinciding with the circumferential direction of the blade, wherein the blade is made of varying cross-sections of profiles and leaned such that the centre of gravity in a mid-section of each varying cross-section is shifted opposite to the direction of blade rotation and the blade sections from hub profile to tip profile are twisted in a gradual manner, and wherein said blade has an aspect ratio h/c (blade height/chord height at hub) of 1.326, the cross sectional areas at mean section ±36±2% varies from at hub to −30±2% at tip.

4. The improved three dimensional blade for axial steam turbine as claimed in claim 3 wherein said stagger angle range is from +10±1.0 to −12.2±1.0 degrees with respect to mean section for effective loss reduction.

5. The improved three dimensional blade for axial steam turbine as claimed in claim 3 wherein the aspect ratios for effective loss reduction varies from 0.85 to 1.5.

6. The improved three dimensional blade for axial steam turbine as claimed in claim 5 wherein an aspect ratio of h/c=0.8–1.5 provides effective loss reduction and improved efficiency with respect to a cylindrical blade.

7. An improved three dimensional blade for axial steam turbine comprising a leading edge with an inlet flow angle and a trailing edge with an outflow angle, a pressure face between the leading edge and the trailing edge, a suction face between the leading edge and the trailing edge on the opposite side of the pressure face and a chord, which is the line connecting the leading edge and the trailing edge through a stagger angle formed at the intersection of said chord and a U-axis coinciding with the circumferential direction of the blade, wherein the blade is made of varying cross-sections of profiles and leaned such that the centre of gravity in a mid-section of each varying cross-section is shifted opposite to the direction of blade rotation and the blade sections from hub to tip are twisted in a gradual manner, and wherein the original height of the blade is reduced in height from tip side or extrapolated toward tip side.

* * * * *

UNITED STATES PATENT AND TRADEMARK OFFICE

CERTIFICATE OF CORRECTION

PATENT NO. : 6,709,239 B2
DATED : March 23, 2004
INVENTOR(S) : Amrit Lai Chandraker It is certified that error appears in the above-identified patent and that said Letters Patent is hereby corrected as shown below:

Title page,
Item [30], Foreign Application Priority Data, should read as follows:
-- [30] Foreign Application Priority Data
June 27, 2001 (IN)……..715/Del/01 --

Signed and Sealed this

Twenty-second Day of June, 2004

JON W. DUDAS
*Acting Director of the United States Patent and Trademark Office*